US005565904A

United States Patent [19]

Sawano

[11] Patent Number: 5,565,904

[45] Date of Patent: Oct. 15, 1996

[54] IMAGE RECORDING METHOD AND APPARATUS THAT USES MICRO LINE TECHNIQUE

[75] Inventor: Mitsuru Sawano, Shizuoka, Japan

[73] Assignee: Fuji Photo Film Co., Ltd., Kanagawa, Japan

[21] Appl. No.: 618,612

[22] Filed: Mar. 21, 1996

Related U.S. Application Data

[63] Continuation of Ser. No. 205,733, Mar. 4, 1994, abandoned.

[30] Foreign Application Priority Data

Mar. 4, 1993 [JP] Japan ..... 5-094831

[51] Int. Cl.[6] ..... B41J 2/325; B41J 2/36

[52] U.S. Cl. ..... 347/183

[58] Field of Search ..... 347/183; 400/120.07

[56] References Cited

U.S. PATENT DOCUMENTS 5,297,878 3/1994 Saito et al. ..... 400/120

5,382,965 1/1995 Yamakawa et al. ..... 347/183

FOREIGN PATENT DOCUMENTS 3219969 9/1991 Japan ..... B41J 2/355

419163 1/1992 Japan ..... B41J 2/36

*Primary Examiner*—Benjamin R. Fuller

*Assistant Examiner*—Lynne Anderson

*Attorney, Agent, or Firm*—Sughrue, Mion, Zinn, Macpeak & Seas

[57] ABSTRACT

A method and apparatus of recording an image by digital information on an analog record material, in which the image information is stored as gradation image data representing figure image and binary data representing character image. The binary data representing character image is stored as a state of micro lines representing the character image. The gradation image data of each pixel is converted to binary data representing a plurality of parallel micro lines forming the each pixel, gradation in each pixel being represented by the number of the micro lines. The image is recorded on the analog record material by means of the micro lines corresponding to the binary data of the gradation image and character image.

4 Claims, 4 Drawing Sheets

IMAGE RECORDING METHOD AND APPARATUS THAT USES MICRO LINE TECHNIQUE

This is a Continuation of application Ser. No. 08/205,733, filed Mar. 4, 1994, now abandoned.

BACKGROUND OF THE INVENTION

The present invention relates to an image recording method and apparatus for thermosensible paper, thermosensible film, thermographic paper, thermographic film and etc., and particularly relates to an image recording method and apparatus in which one pixel in the image portion consists of a plurality of micro-lines, so that the area gradations corresponding to the image density is performed.

In an image recording apparatus such as a character printer and an image printer, there is a printer of a type which heats the thermosensible material by a thermal head so as to form images, e.g. characters, and drawings. In case of forming images by use of the thermosensible material, although some images are sufficiently represented by one color (e.g. black), in order to reply to many requests of various expression, it is required to provide a thermal recording method accomplishing multiple-color recording having high contrast image.

As a conventional image recording method, a melting type thermal transfer recording method is provided, whereas the method heats an ink film from a reverse side thereof so as to transfer the melted or softened ink to a normal paper. This method is suitable to recording binary image such as letters, line drawings or the like.

The melting type thermal transfer recording method is disclosed in Japanese Patent Unexamined Publication No. Hei. 3-219969. In the method, a thermal head is provided with a heating element having a width in the record paper transferring direction (secondary scanning direction) narrower than a length in the head of a perpendicular direction (main scanning direction) thereto, the recording paper is transferred intermittently every number of units which correspond to the value of the width of the secondary scanning direction. During the transfer, each heating element is energized in accordance with the image data to change the recording area in one recording pixel so as to perform the gradation expression.

Hereupon, the above recording method uses the width of the heating element in the secondary scanning direction as the unit recording width. It is necessary, however, to narrow the width of the secondary scanning direction in order to improve the gradation of the recording pixel. The thermal head has a limit relating to production cost and durability, therefore, it is difficult to obtain a higher gradation.

Therefore, as an improved melting type thermal transfer recording method, a method is disclosed in Japanese Patent Unexamined Publication No. Hei. 4-19163. There is provided a melting type thermal transfer recording method to record an image providing higher gradation without particularly narrowing the width of heating element.

In the improved method, the thermal head is transferred intermittently every unit width relative to the recording paper, the unit width being narrower than the width of the heating element in the secondary scanning direction. The heating element is driven every unit width so as to change the recording width in the secondary scanning direction in accordance with the density of pixel thus recorded.

The heating element is driven every transferring unit width in accordance with the density of pixel thus recorded so as to change the recording width narrower than the width of the heating element in the secondary scanning direction. Accordingly, it may be performed to record an image providing higher gradation without particularly narrowing the width of the heating element.

As shown in FIGS. 4 and 5, the above melting type thermal transfer recording method forms pixel 1 including a plurality of micro lines 1*a*–1*n* in parallel to the secondary scanning direction, e.g. disposing the pixels formed to a square of 122 μm side respectively into matrix formation of a pitch of 2 μm, so as to form required gradation image 2.

While the gradation image 2 is formed, e.g. the heating elements of the thermal head corresponding to the micro lines 1*a*–1*e* are heated, and other micro lines 1*f*–1*n* thereunder is not heated. Namely, the heating element of the thermal head is driven and heated so as to heat the micro lines of each record pixel 1A, 1B, 1C, . . . in the order of secondary scanning direction and to increase the number of the micro lines heated in accordance with the density of the image 2, and the required image 2 is formed.

Accordingly, the number of the micro lines 1*a*–1*n* of each record pixel 1A, 1B, 1C, . . . is determined in accordance with the density of the image 2 so as to change an area ratio of a heated portion to an unheated portion. Thus, some pixels having different gradations from each other are combined so that the image 2 is formed as a completion having areal gradations including half-tone portions. Though a transferring resolution in the secondary scanning direction is therefore low, a gradational image is obtained.

However, the above conventional method of melting type thermal transfer record has the following problem.

In each record pixel 1A, 1B, 1C, . . . , some lines in the micro lines adjoining each other at the same one side of the pixels are heated, and other lines in the micro lines at another side of the pixel are not heated. The resolution of the image thus formed is relatively high.

In the case that characters are formed by the above recording, particularly one pixel unit in an inclined portion 3 of character as shown in FIG. 5 is represented by only black or only white, a difference 3*a* of inclined line in which the pixels record are continuously connected appears corresponding to at least one pixel. Therefore, the resolution when representing the character decreases, and a problem with respect to forming the character remains.

SUMMARY OF THE INVENTION

An object of the present invention, therefore, is to solve the aforementioned problems, that is, to provide an image recording method and apparatus for recording an image having high grade gradation and a character having high resolution.

The above object is accomplished by providing a method converting said gradation image data on each pixel to image data on a plurality of micro lines forming each pixel and arranged in parallel, gradation in each pixel being represented by the number of said micro lines so as to realize an areal gradation, determining positions of micro lines in each unit pixel representing said binary data; and recording said image on said analog record material by means of said gradation image data and binary data which are represented by said micro lines.

Therefore, not only the gradation image may be recorded, but also a character image having high resolution may be recorded.

Further in the above method, the recording step includes thermosensible recording. As a result, various recording methods are performed, e.g. thermal color development heating thermosensible paper so as to develop colors in accordance with heat energy, melting type thermographic recording method transferring various ink to normal paper, sublimating type transfer recording method recording various ink on an image receiving layer of record paper by heat diffusion.

Furthermore in the above method, said determining step may use each unit pixel consisting of the number of micro lines less than the number of micro lines which represent said each pixel of said binary data. Therefore, not only the gradation image may be recorded, but also a character image having high resolution may be recorded.

And also, the above object is accomplished by providing an apparatus for recording an image stored as digital information including pixels on an analog record material, said apparatus comprising: means for storing said digital information as gradation image data representing figure image and binary data representing character image in said image; means for converting said gradation image data on each pixel to image data on a plurality of micro lines forming said each pixel and arranged in parallel, gradation in each pixel being represented by the number of said micro lines so as to realize an areal gradation; means for determining positions of micro lines in each unit pixel representing said binary data; and means for recording said image on said analog record material by means of said gradation image data and binary data which are represented by said micro lines.

DESCRIPTION OF THE PREFERRED EMBODIMENT

Preferred embodiments of the present invention will be described with reference to the accompanying drawings.

Figure 1:
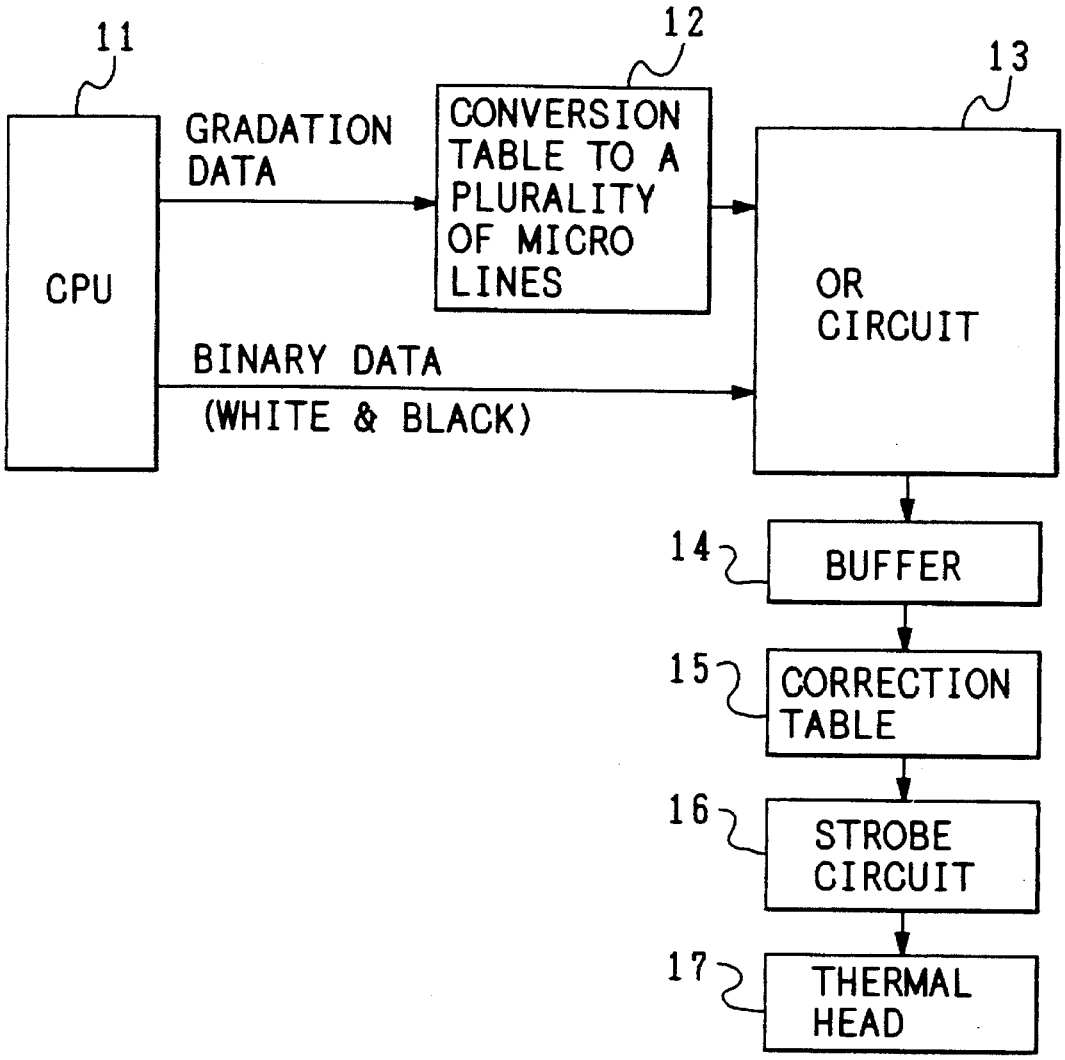
FIG. 1 is a block diagram showing a method and apparatus of recording image in accordance with a preferred embodiment of the invention.

FIG. 1 is a block diagram showing a method and apparatus of recording an image in accordance with a preferred embodiment of the invention. An image signal of each pixel input from a TV camera or a scanner is subjected to A/D conversion as gradation image data, alternately, character data is subjected to conversion to binary character data representing white or black. Both data are stored in RAM (not shown) in CPU 11.

When recording, the gradation image data which is read out from the RAM in CPU 11 is input to a conversion table 12 converting the image data to data on micro lines, respectively. And the binary character data is input to OR circuit 13.

Figure 4:
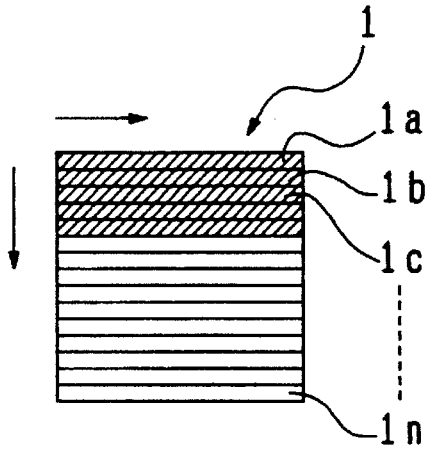
FIG. 4 shows a pixel formed by a plurality of micro lines.
Figure 5:
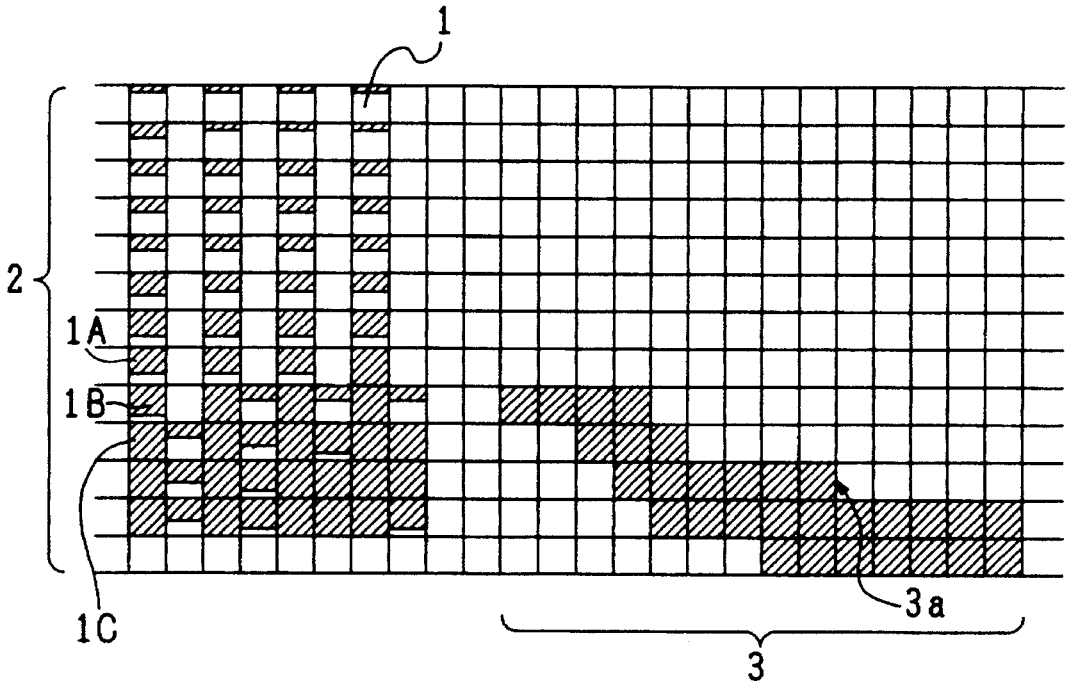
FIG. 5 shows a recorded state of the inclined portion of the character by a conventional image recording apparatus.

With respect to the gradation image data input to the conversion table 12, as shown in FIG. 4, a plurality of micro lines 1*a*–1*n* is disposed in parallel to the secondary scanning direction so as to form one pixel, and then the gradation image data is converted to data onto the plurality of micro lines.

The image data which is converted into the micro lines at the conversion table 12 is input to the OR circuit 13. The 0R circuit 13 performs an OR operation on the image data from the conversion table 12 and the binary character data from the CPU 11, so that the image data and the binary character data are registered and output to buffer 14 as recording data, the buffer 14 temporarily storing the data.

That is, the OR circuit 13 registers the image data and the character data so as to change between On and Off conditions of driving the heating element of a thermal head 17 on each micro line as a conversion means.

The data stored in the buffer 14 is input to the correcting table 15 so as to perform historical correction and adjacent correction. The correcting table 15 outputs the correction data to a strobe generating means, i.e. strobe circuit 16 as a correcting means.

The strobe circuit 16 instructs the thermal head of heating periods of each of the heating elements which are disposed by a predetermined pitch in series in the main scanning direction of the thermal head 17. The strobe circuit 16 generates a pulse strobe signal as a control signal to the thermal head 17.

Figure 2:
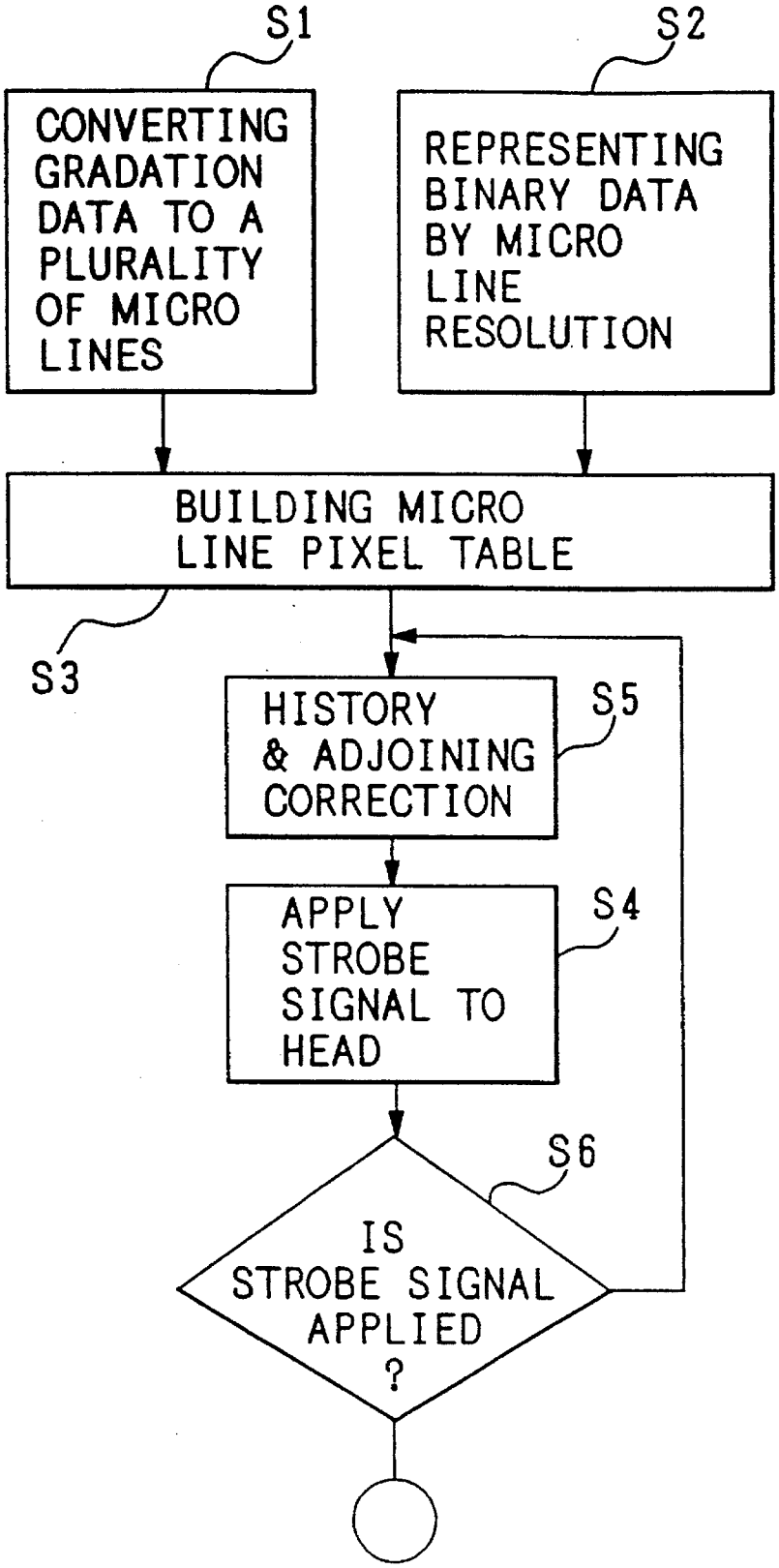
FIG. 2 is a flow chart showing operation of record of the image recording apparatus of the invention.

Next, the operation of the image recording apparatus of the above construction will be described by use of a flow chart as shown in FIG. 2.

While recording, in a step S1, the gradation image data stored in the RAM of the CPU 11 is read out from the RAM and input to the conversion table 12. The conversion table 12 converts the gradation data to data onto the plurality of micro lines constituting each recording pixel.

The image data converted in the conversion table 12 and the binary character data read out from RAM of the CPU 11 are input to the OR circuit 13 in a step $2. Each recording pixel representing the binary character data is formed by the plurality of micro lines which are disposed in the secondary scanning direction with a micro line resolution, that is, the character image is represented as one micro line is a unit pixel.

The OR circuit 13 performs an OR operation on the image data from the conversion table 12 and the binary character data. And the OR circuit 13 determines On or Off of driving the heating element on each micro line, that is it is determined whether the heating element is heated or not. The output data from the OR circuit 13 is stored temporarily in the buffer 14 as recording data for the recording material, e.g. thermal sensitive film, etc.

When recording by the heating element of the thermal head, in the case of increasing print speed, the temperature of the heating element does not decrease to a low enough level between the last recording and the next recording of the micro lines in each pixel. Hereupon, if the next micro line is heated by the heating element in condition of insufficient decrease of the temperature, the image thus recorded has uneven density and bleeding, and therefore it is difficult to record accurately.

Thus, in step S5, the driving interval of the heating element is corrected by the correction table 15. The strobe signal from the strobe circuit 16 is input to the thermal head on the basis of the correction data from the correction table 15. Concretely, the strobe circuit 16 outputs pulse strobe signal to the thermal head 17 in step S4 so as to instruct the heating interval of the heating element of the thermal head on the basis of the correction data. As a result, the heating element is driven in the instructed interval, so that high contrast recording of the image and character to the record material is performed. In step S6, it is determined whether or not the strobe signal is applied to the thermal head 17. And when the strobe signal is detected, the operation in the step S5 is executed again.

Continuously, the loop operation in the order of the step S5, step S4, step S6 and step S4 are executed repeatedly equal to the number of the determined micro lines, so that the image of each unit pixel is recorded on the record material in the order.

As was described above, the gradation image 2 on each pixel is converted to image data on a plurality of micro lines forming each pixel and arranged in parallel, gradation in each pixel being represented by the number of the micro lines. Further with respect to character image, positions of micro lines in the secondary scanning direction are determined in each unit pixel representing the character image. Therefore, not only a quality of the figure image is kept, but also the character image may be recorded in high representation.

Figure 3:
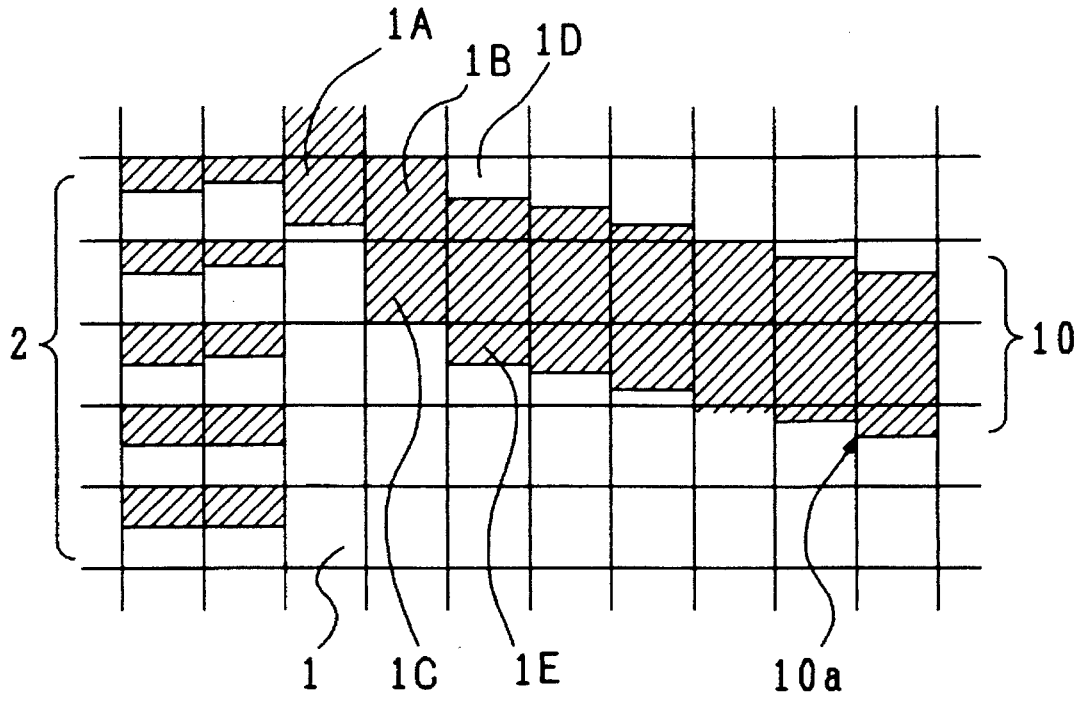
FIG. 3 shows determination of micro lines of each pixel when image recording with respect to the inclined portion of a character.

Thus, the state recorded on the record material regarding the character data corrected by the correction table 15 will be described in accordance with FIG. 3. The pixel of this embodiment has a square configuration of side size 122 μm and has 2 μm pitch of heating dots disposed in matrix state.

Each record pixel of image 2 consists of a plurality of micro lines. In the micro lines, the number of micro lines to be heated from the first line are determined in the conversion table 12. In Fig, 3, relative to the order of the micro line, that is, relative to the secondary scanning direction, the amount of heating portion increases.

An inclined line 10 of characters is represented by using a set of micro lines as each unit pixel by means of the correction table 15, in which each record pixel 1A, 1B, 1C, . . . is formed by the unit pixels. For example, the record pixel 1A is set to heat almost all lines other than approximately one or two micro lines at the under position (determined from FIG. 3) of the record pixel 1A. Further the record pixels 1B and 1C are set to heat all of the micro lines, the record pixel 1D is set to heat the lower half micro lines and the record pixel 1E is set to heat the upper half micro lines. In accordance with the information of character shape thus recorded on the record material, therefore, the preferred micro lines may be recorded by heating the heat element of the thermal head.

Accordingly, at the adjacent pixels of the inclined portion 10, the difference **10*a*** in the line decreases and is drawn near the curving line, so that the character record having high secondary scanning resolution is realized.

Additionally, the present invention is not restricted to the above embodiment. For example, the character portion is represented by using the number of micro lines less than the number of micro lines of the above embodiment as unit pixels. And the only preferable number of micro lines may be selected in the secondary scanning direction. Therefore, some of the micro lines of the above embodiment may be combined into one micro line, that is the combined micro line may have a larger width than the above embodiment. Accordingly, even if the number of the micro lines is reduced, the same effect of the above embodiment may be obtained.

Furthermore, the above embodiment includes the recording of image and character with respect to use of a melting type thermal transfer recording method. However, a record material may be used of a color thermal sensitive paper, white and black thermal sensitive paper for facsimile or word processor, thermal sensitive film for medical treatment (e.g. Thermal sensitive film for FTI produced by Fuji Photo Film Co., Ltd.), and etc. And also, the invention may be applied to a color thermal transfer recording method, in which a record head having a plurality of record pixels disposed in the main scanning direction is used so as to change a length, in the secondary scanning direction, of an ink dot line recorded in pixels in accordance with a density of image, and the color image may be recorded on a record paper by at least tree kinds (yellow, magenta and cyan) of ink dots.

Moreover, the invention may be applied to a laser printer, a liquid crystal shatter line printer, an ink jet printer and also aerial gradation recording except for a thermal record recording on a paved road, i.e. a pedestrians' crossing writing machine using a low melting point grass.

Finally, the image recording method of the invention may transfer an image represented by an ink-sheet absorbing black color or ultraviolet ray onto a transparent sheet. And the transparent sheet thus recorded may be used as a lith film, and when the image is printed on a PS plate by means of an ultraviolet ray, an off-set printing process is improved with respect to the processing speed, labor and renewing toward a dry processing. Alternately, when the image is printed on a silver halide sensitive material by means of visible light or infrared rays, a process of superimposing characters onto a photograph is improved with respect to the processing speed, labor and renewing toward a dry processing.

As was described above, in accordance with the present invention, the gradation image on each pixel is converted to image data on a plurality of micro lines forming each pixel and arranged in parallel, gradation in each pixel being represented by the number of the micro lines. Further with respect to character image, positions of micro lines in the secondary scanning direction are determined in each unit pixel representing the character image. Therefore, not only a quality of the figure image is kept, but also the character image may be recorded in high representation.

What is claimed is:

1. A method of recording an image stored as digital information on an analog record material, comprising steps of:

storing figure image data as gradation image data and character image data as binary data representing a plurality of parallel micro lines forming said character image;

converting said gradation image data of each of a plurality of pixels to binary data, said binary data representing a respective plurality of parallel micro lines for each of said plurality of pixels, the gradation in each of said plurality of pixels being represented by a number of the respective plurality of parallel micro lines so as to realize an areal gradation;

determining, based on resolution of said character image, one of a top position and a lowest position of each of said plurality of pixels where said respective plurality of parallel micro lines are to be adjacently formed; and recording said image on said analog record material by forming said micro lines corresponding to said binary data of said gradation image and character image in accordance with said determining step.

2. The method according to claim 1, wherein said recording step includes thermosensible recording.

3. The method according to claim 1, wherein in said recording step, a unit representing said character image includes at least one large-width micro lines.

4. An apparatus for recording figure and character images as digital information on an analog record material, comprising:

means for storing said figure image digital information as gradation image data and said character image digital information as binary data representing a plurality of micro lines forming said character image in parallel arrangement, said plurality of micro lines being used by a plurality of pixels for representing said character image;

means for converting said gradation image data of each of said plurality of pixels representing said gradation image to binary data representing a respective plurality of micro lines forming each of said plurality of pixels, the gradation in each pixel being represented by a number of the respective plurality of parallel micro lines so as to realize an areal gradation;

means for determining, based on resolution of said character image, one of a top position and a lowest position of each of said plurality of pixels where said respective plurality of parallel micro lines are to be adjacently formed, and outputting a result; and means for recording said image on said analog record material by forming said micro lines corresponding to said bineary data of said gradation image and character image in accordance with the result outputted by said determining means.

* * * * *